United States Patent [19]

Morin

[11] 4,300,472

[45] Nov. 17, 1981

[54] SOLVENT TYPE CEMENTER

[75] Inventor: Robert W. Morin, Salem, Mass.

[73] Assignee: Boston Machine Works Company, Lynn, Mass.

[21] Appl. No.: 143,286

[22] Filed: Apr. 24, 1980

[51] Int. Cl.[3] ..... B05C 1/02

[52] U.S. Cl. ..... 118/245; 118/250; 118/259

[58] Field of Search ..... 118/259, 246, 245, 249, 118/250

[56] References Cited

U.S. PATENT DOCUMENTS

| | | | |
|---|---|---|---|
| 2,205,443 | 6/1940 | Soltan | 118/259 X |
| 2,664,068 | 12/1953 | Osgood | 118/246 X |
| 2,774,330 | 12/1956 | Schaefer | 118/259 |
| 3,288,106 | 11/1966 | Heiseler | 118/246 X |

OTHER PUBLICATIONS

"New York Rubber Cementer", Model No. RP, published by Boston Machine Works Co.

"Boston Speedflex Cementer", Model 94, published by Boston Machine Works Co.

*Primary Examiner*—John P. McIntosh

*Attorney, Agent, or Firm*—Morse, Altman, Oates & Dacey

[57] ABSTRACT

A solvent type cementer for applying a uniform thin layer of solvent cement to one side of flat work pieces, such as, for example, sock linings, innersoles, watch bands, bill folds, belts and the like. The solvent type cementer comprises an enclosure for containing the solvent cement, a cement applying roller partially disposed within the enclosure and in contact with the cement, a pair of rolls mounted adjacent the cement applying roller for flexing the flat work pieces against the roller and a drive of unitary construction characterized by being driven by a single pulley.

6 Claims, 5 Drawing Figures

SOLVENT TYPE CEMENTER

BACKGROUND OF THE INVENTION

1. Field of the Invention

The present invention relates to solvent type cementers and, more particularly, to a solvent type cementer for applying a uniform thin layer of solvent cement to flat work pieces, such as, for example, sock linings, watch bands, belts and the like. The solvent type cementer is characterized by rolls for flexing the work pieces during the cement application and by a drive arrangement driven by a single pulley.

2. The Prior Art

Flat work pieces of the type here involved have been coated with layers of cement in various ways and with varying degrees of success. The successful application of a uniform, thin layer of cement to any such flat work piece involves controlling the pressure between the work and the cement applying surface in such a way that no squeeze-out occurs on the sides and yet the entire surface from edge to edge receives an even coating of cement. The problem is particularly acute in applications involving solvent type cements whose viscosity is such as to require the application of such degree of pressure, in order to avoid spotty coatings, that squeeze-out does occur at the sides. Applying uniform, thin layers of solvent type cements of differing viscosities to flat work pieces, therefore, involves difficult complexities.

SUMMARY OF THE INVENTION

The primary object of the present invention is to provide a solvent type cementer for applying a uniform thin layer of solvent cement to flat work pieces comprising an enclosure for containing solvent cement, a cement applying roller partially disposed within the enclosure and in contact with the cement, a pair of rolls rotatable in opposite directions operatively mounted above the cement applying roller, the pair of rolls designed for flexing the flat work against the cement roller, and a unitary drive for driving the pair of rolls faster than driving the cement applying roller. The operative arrangement between the cement applying roller and the pair of rolls is such that, due to the flexing of the flat work pieces effected by the pair of rolls and against the surface of the cement applying roller, a lesser amount of pressure between the work and the roller is needed for coating the work evenly and yet without any squeeze-out at the sides. The unitary drive for the roller and the pair of rolls is characterized by being driven from a single pulley. The drive further includes a drive shaft mounting the pulley at one end and the cement applying roller at the other end, and a second shaft disposed in parallel spaced relation to the drive shaft and mounting means for transferring torque from the drive shaft to one of the pair of rolls. The transfer of torque is effected in such a manner that the r.p.m. of the pair of rolls is about four times the r.p.m. of the cement applying roller.

Other objects of the present invention will in part be obvious and will in part appear hereinafter.

The invention accordingly comprises the solvent type cementer, together with its components, parts and their interrelationships, which are exemplified in the present disclosure, the scope of which will be indicated in the appended claims.

BRIEF DESCRIPTION OF THE DRAWINGS

For a fuller understanding of the nature and objects of the present invention, reference is made to the following detailed description, which is to be taken in connection with the accompanying drawings, wherein.

DETAILED DESCRIPTION OF THE PREFERRED EMBODIMENT

Figure 1:
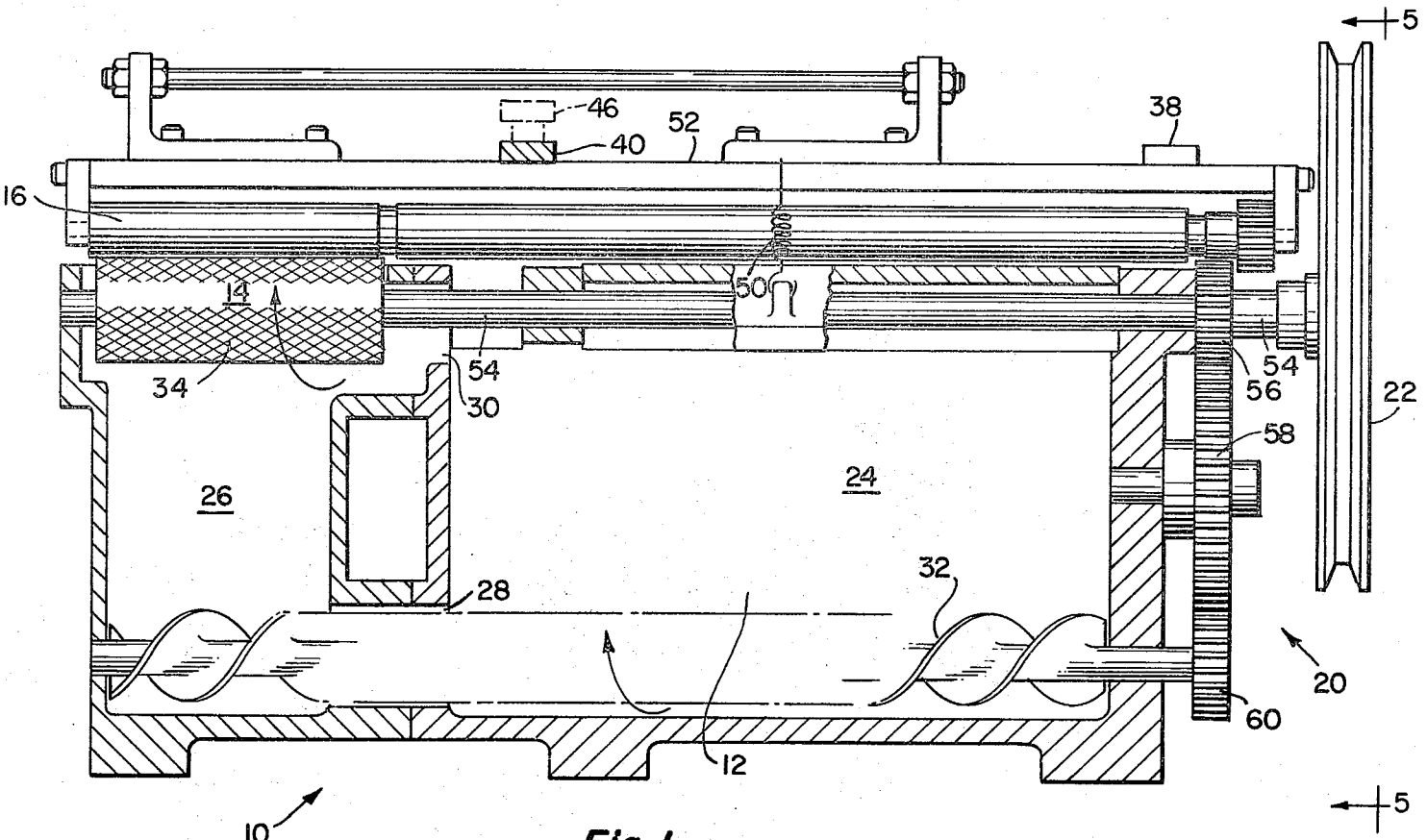
FIG. 1 is a front elevational section of a solvent type cementer constructed in accordance with the present invention.

Generally, the illustrated machine is a bench type solvent type cementer 10 for use in applying uniform, thin layers of solvent cement to one side of flat work pieces such as, for example, sock linings, innersoles, watch bands, bill folds, belts and the like. Any commonly used solvent cement can be applied by the cementer 10, be it neoprene, urethane, rubber or the like, and in a wide range of viscosities, according to the work requirements. The solvent type cementer 10 basically comprises an enclosure 12 for containing solvent cement, a cement applying roller 14, a pair of rolls 16 and 18, and a drive arrangement 20 of unitary construction characterized by being driven by a single pulley 22.

Because it contains a solvent cement, the enclosure 12 is built as air-tight as practicable and it is to be cleaned often. The enclosure 12 is formed of two interconnecting compartments, a main compartment 24 and a smaller compartment 26. The compartments 24 and 26 are interconnected at the bottom by a passage 28 and at the top by a small channel 30. A conveyor 32 is rotatably mounted in the bottom portions of the two compartments 24 and 26 and extends through the passage 28. Clockwise rotation (viewed from the drive end) of the conveyor 32 causes solvent cement to circulate between the two compartments 24 and 26, first by moving the solvent cement from the main compartment 24 through the passage 28 into the smaller compartment 26. As the smaller compartment 26 fills up with solvent cement, the solvent cement continuously wets the knurled surface 34 of the cement applying roller 14 since the roller 14 is partially disposed within the compartment 26. The excess solvent cement is returned to the main compartment 24 via the channel 30.

Figure 4:
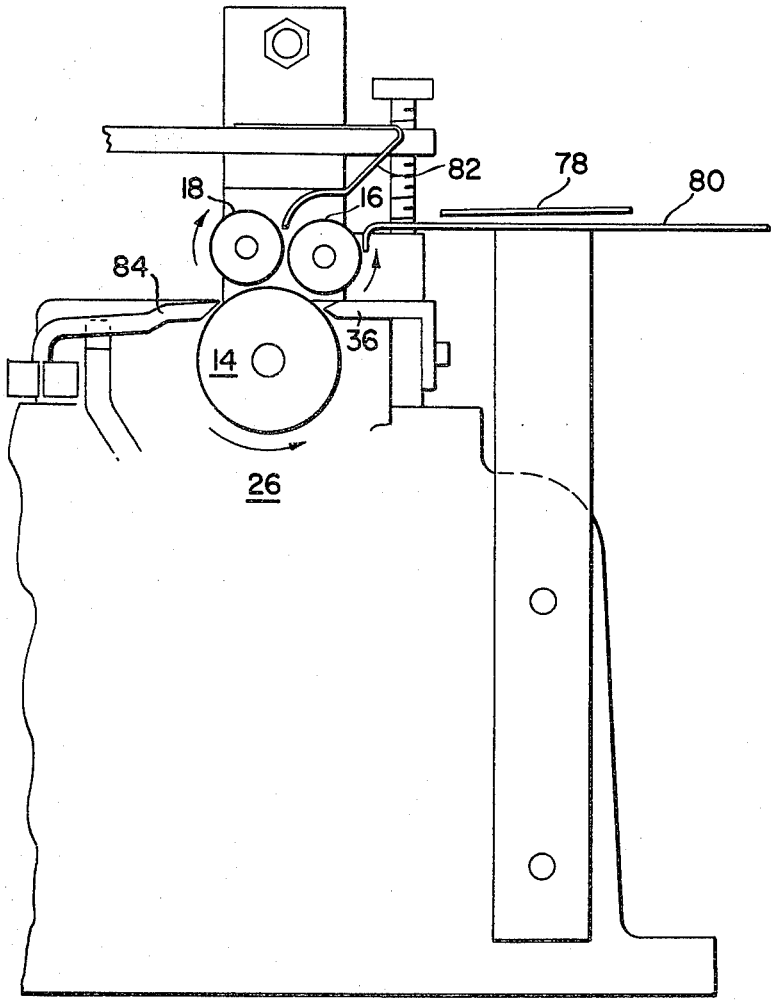
FIG. 4 is a vertical side elevation, partly in section, along the lines 4—4 of FIG. 2.

The thickness of the layer of solvent cement carried by the knurled surface 34 of the cement applying roller 14 is determined by a doctor blade 36 operatively and adjustably mounted adjacent the uptake side of the roller 14, observe FIG. 4. Thus, by adjusting the clearance between the knurled surface 34 and the doctor blade 36, the operator can vary the thinness of the layer of solvent cement to be applied by the cement applying roller 14 to a work piece.

Figures 2, 3:
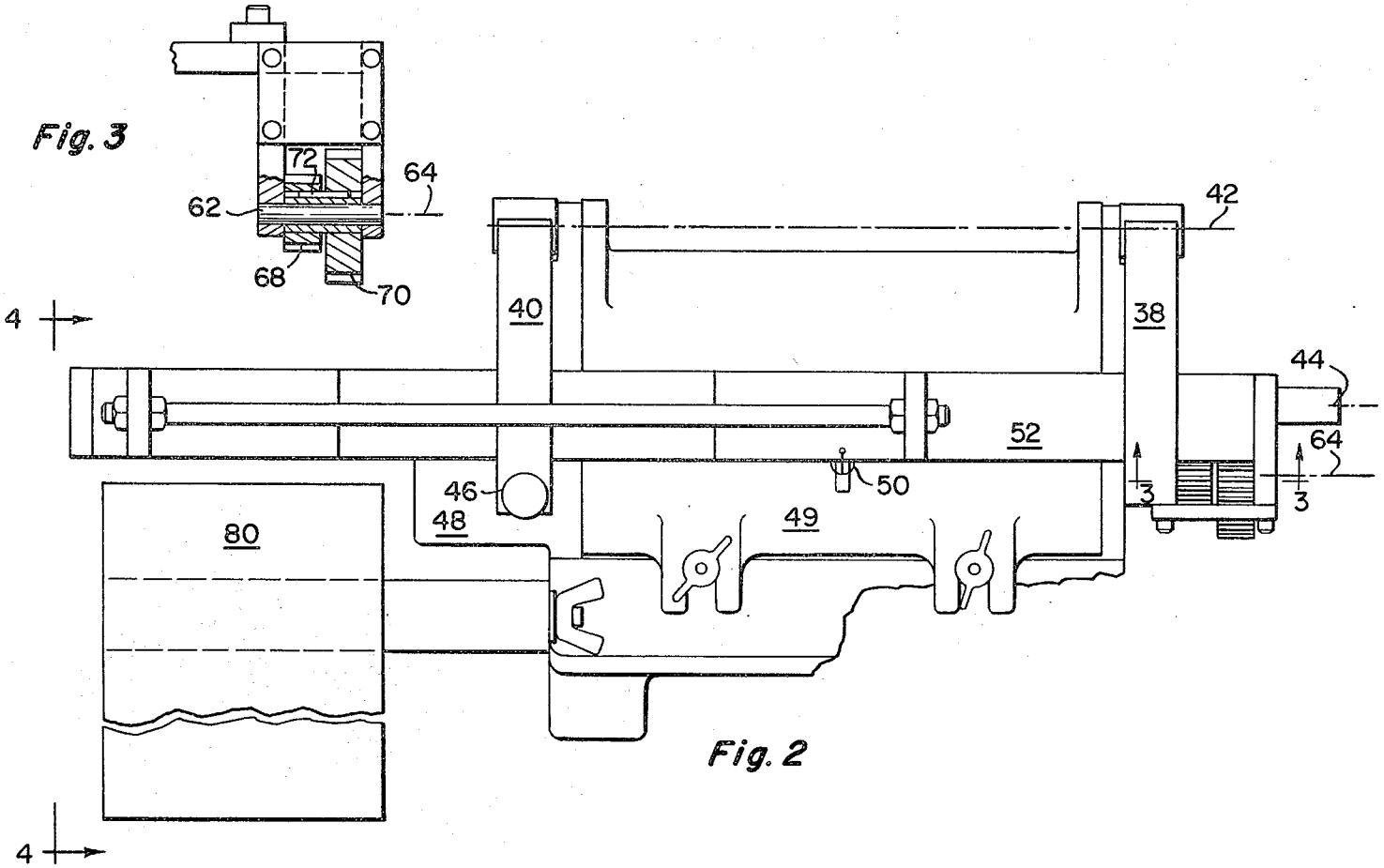
FIG. 2 is a top plan view of the solvent type cementer of FIG. 1.
FIG. 3 is a vertical section along the lines 3—3 of FIG. 2, with parts broken away.
Figure 5:
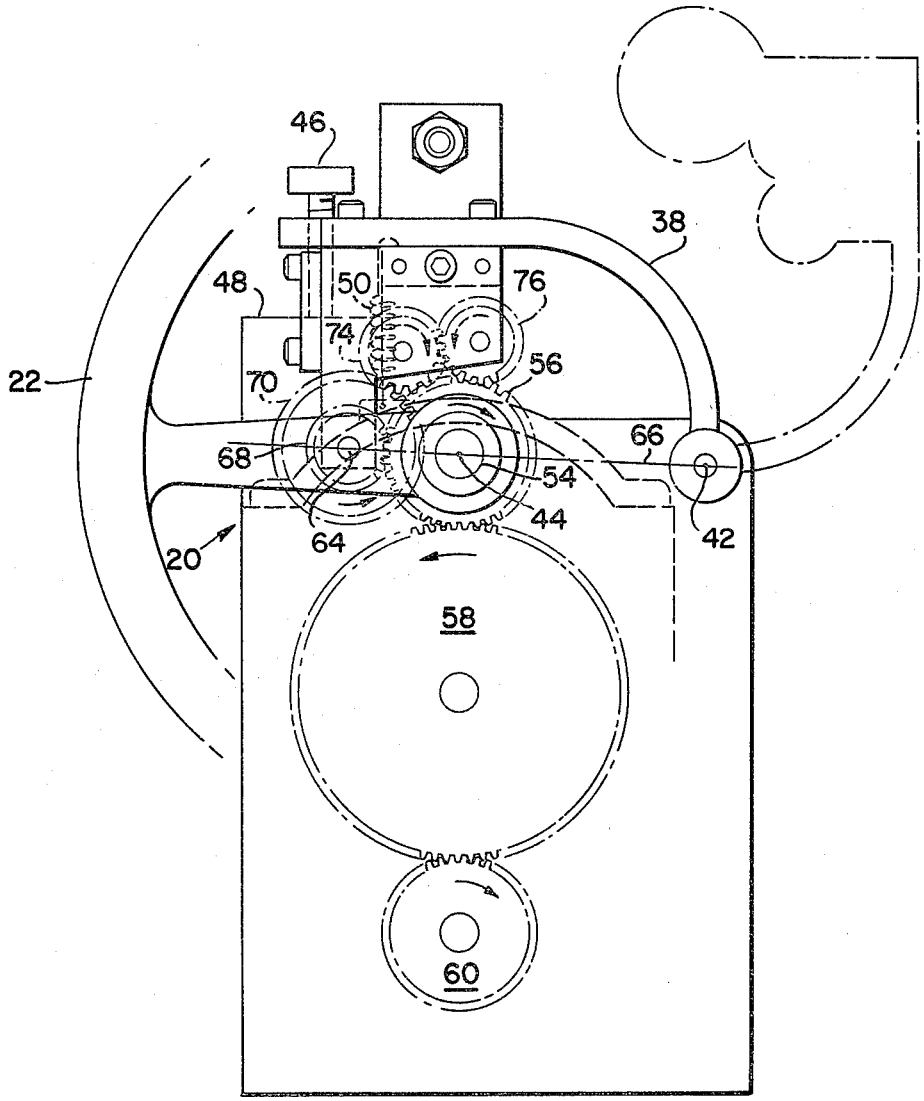
FIG. 5 is a vertical side elevation along the lines 5—5 of FIG. 1.

The pair of rolls 16 and 18 are each formed with smooth surfaces and are carried by a pair of overhang arms 38 and 40, observe FIGS. 2 and 5. Overhang arms 38 and 40 are pivotable between a position adjacent the cement applying roller 14, (the operative position) shown in solid lines, and a position spaced from the roller 14, (the inoperative position) shown in phantom lines, about an axis 42. The axis 42 is parallel spaced from an axis 44 about which the cement applying roller 14 is rotatable.

Since the function of the pair of rolls 16 and 18 is to provide flexing to the work pieces against the cement applying roller 14, a certain minimum clearance between the surfaces of the roller 14 and of the pair of rolls 16 and 18 is required. Further, this minimum clearance needs to be adjustable to accommodate work pieces of differing thickness. These requirements for a minimum clearance and for adjustability in that clearance are effected by an adjustable limit and elevating screw 46 bearing against a plate 48 of the cementer 10. Alternately, two screws can be provided, one as a limit screw to set the minimum clearance and the other as an elevating screw to adjust the clearance between the set minimum and a maximum value. A manually disengageable tension spring 50, connected between a top plate 52 and a cover plate 49 (note FIG. 2), maintains the pair of rolls 16 and 18 at the set minimum clearance from the cement applying roller 14 in the operative position.

Each of the operative parts of the solvent type cementer 10, including the cement applying roller 14, the pair of rolls 16 and 18 and the conveyor 32, are driven by the drive 20 of unitary construction from the single pulley 22. This drive 20 is best described with reference to FIGS. 1, 3 and 5. The pulley 22 is secured about one end of a drive shaft 54 and the cement applying roller 14 is secured about the other end of the drive shaft 54. A main drive gear 56 is mounted on the drive shaft 54 adjacent the pulley 22. The main drive gear 56 drives the conveyor 32 via a large transfer gear 58 and a gear 60. The main drive gear 56 also drives the pair of rolls 16 and 18 as follows. A second shaft 62 is mounted about an axis 64 in parallel spaced relation to the axis 44 of the drive shaft 54. It is to be noted that the axes 42, 44 and 64 lie in the same plane 66 in the operative position, observe FIG. 5. A pair of transfer gears 68 and 70, coupled to one another by an element 72, are rotatably disposed about the second shaft 62. The smaller transfer gear 68 is operatively mounted adjacent the main driving gear 56 and is rotated thereby in an opposite direction. Due to the coupling element 72, the larger transfer gear 70 is rotated in the same direction as the smaller transfer gear 68. This larger transfer gear 70 is operatively mounted adjacent a drive gear 74 of the front top roll 16 and rotates this roll 16 in a direction opposite to that of the gear 70. The drive gear 74 is meshed with a drive gear 76 for the rear top roll 18. Consequently, the pair of rolls 16 and 18 are driven in opposite directions relative to one another.

Due to the relative respective diameters of the gears 56, 68, 70, 74 and 76 and the respective numbers of teeth carried by each of these gears, transfer of torque from the drive shaft 54 to the drive gear 74 of the roll 16 is effected in such a manner that the r.p.m. of the pair of rolls 16 and 18 is about four times the r.p.m. of the cement applying roller 14. This rotational speed translates into a linear speed whereby the rolls 16 and 18 run about twice the linear speed of the roller 14, a circumstance related to their respective diameters. As will be noted, the diameter of the roller 14 is about twice the diameter of each of the rolls 16 and 18.

Operation

The operation of the solvent type cementer 10 is as follows. The operator assures that the enclosure 12 is filled with solvent cement of the desired kind. Taking by hand one flat work piece 78, note FIG. 4, the operator places the work piece 78 on a work table 80 and advances the piece 78 onto the front top roll 16. A work deflector 82 directs the flat, flexible work piece 78 into the bite of the oppositely rotating pair of rolls 16 and 18. The rolls 16 and 18 grab the work piece 78 and flex it against the knurled, cement carrying surface 34 of the cement applying roller 14. A uniform thin layer of solvent cement is thereby applied onto one side of the work piece 78, without any squeeze-out on the sides of the work piece 78. Any such squeeze-out of solvent cement at the sides would not only render the particular work piece a reject but would also contaminate the top rolls 16 and 18 with solvent cement. Contamination of the top rolls 16 and 18 with solvent cement requires that the cementer 10 be stopped and further cementing operations be suspended until the top rolls 16 and 18 have been thoroughly cleaned of solvent cement,—an expensive operation. Due to the flexing of the work piece 78 against the cement applying roller 14, a lesser amount of pressure between the roller 14 and the pair of rolls 16 and 18 is required to apply a uniform layer of cement than with machines of conventional design. Because of this reduced pressure, the troublesome squeeze-out of solvent cement at the sides of the work has been eliminated.

A plurality of stripper fingers 84, operatively mounted adjacent the offtake side of the cement applying roller 14, strip the cement coated work pieces off from the roller 14. The cement coated work pieces can then be handled manually or mechanically, as appropriate to carrying out further related processes employing the work pieces.

Thus it has been shown and described a solvent type cementer 10 designed for applying uniform thin layers of solvent cement to one side of flat work pieces, which cementer 10 satisfies the objects and advantages set forth above.

Since certain changes may be made in the present disclosure, without departing from the scope of the present invention, it is intended that all matter described in the foregoing specification or shown in the accompanying drawings, be interpreted in an illustrative and not in a limiting sense.

What is claimed is:

1. A solvent type cementer for flat work pieces comprising, in combination:

(a) first means for containing solvent cement;

(b) second means partially disposed within said first means for applying a uniform layer of said solvent cement to one side of said flat work pieces;

(c) third means for flexing said flat work pieces against said second means and including a pair of rolls rotatable in opposite directions, an arm operatively mounting said pair of rolls, said arm pivotable between a position adjacent said second means to a position spaced from said second means about an axis that is parallel spaced from the axis of said second means; and (d) drive means of unitary construction driven by a single pulley for driving said third means faster than driving said second means, said drive means including a drive shaft, said pulley secured to one end of said drive shaft and said second means secured to the other end of said drive shaft, a second shaft mounted on said pivotable arm about an axis in parallel spaced relation to said axis of said second means, and fourth means mounted on said second shaft;

(e) said fourth means including a pair of transfer gears operatively coupled to one another, each of said pair of rolls of said third means provided with respective drive gears, said pair of transfer gears designed for transferring torque from said drive shaft to one of said pair of rolls through one of said drive gears;

(f) said axis of said pivotable arm, said axis of said second means and said axis of said second shaft being disposed in the same plane when said pivotable arm is in said position adjacent said second means.

2. A solvent type cementer for flat work pieces comprising:

(a) an enclosure having two interconnecting compartments for containing solvent cement;

(b) a conveyor for circulating said cement between said two connecting compartments;

(c) a knurled cement applying roller rotatably and partially disposed within one of said connecting compartments in contact with said cement;

(d) a doctor blade operatively and adjustably mounted adjacent the uptake side of said cement roller;

(e) a plurality of stripper fingers operatively mounted adjacent the offtake side of said cement roller;

(f) a pair of smooth top rolls operatively mounted for rotation in opposite directions adjacent said cement roller;

(g) a work deflector operatively mounted adjacent said top rolls to feed said flat work pieces in between said top rolls; and (h) a gear drive arrangement for said conveyor, said cement roller and said pair of top rolls, said gear drive arrangement driven by a single pulley, said gear drive arrangement comprising a drive shaft, a pulley secured about one end of said drive shaft, a main drive gear mounted on said drive shaft adjacent said pulley, a second shaft mounted in spaced parallel relationship to said drive shaft, a pair of transfer gears disposed on said second shaft, one of said pair of transfer gears operatively mounted adjacent said main drive gear, a pair of drive gears cooperating with each other and coaxially mounted with said pair of smooth top rolls, the other of said pair of transfer gears operatively mounted adjacent one of said pair of drive gears, said cement roller secured about the other end of said drive shaft, and a conveyor gear operatively coupled to said main drive gear and secured about one end of said conveyor, whereby said pulley transmits rotational speed to said pair of top rolls which speed is about four times the rotational speed of said cement roller.

3. The solvent type cementer of claim 2 further including an arm pivotable between a position adjacent said cement roller and a position spaced from said cement roller about an axis that is parallel spaced from the axis of said cement roller, said arm operatively mounting said pair of smooth top rolls, said axis of said pivotable arm, said axis of said cement roller and said axis of said second shaft being disposed in the same plane when said pivotable arm is in said position adjacent said second means.

4. In a solvent type cementer for flat work pieces comprising an enclosure for containing solvent cement, a cement roller and a pair of top rolls operatively mounted adjacent said enclosure to guide a flat work piece over said cement roller, the improvement comprising:

a drive arrangement of unitary construction for driving said pair of top rolls at an r.p.m. which is about four times the r.p.m. of said cement roller, said drive arrangement including a drive shaft, a pulley secured to one end of said drive shaft and said cement roller secured to the other end of said drive shaft, a second shaft mounted in parallel spaced relation to said drive shaft, torque transfer means mounted on said second shaft and in operative engagement with said drive shaft and only one roll of said pair of top rolls for transmitting torque from said drive shaft to said one roll of said pair of top rolls, and means for driving the other roll of said pair of top rolls from said one roll of said pair of top rolls such that the top rolls rotate in opposite directions.

5. A drive arrangement of unitary construction, for use in a solvent type cementer for flat work pieces including an enclosure for containing solvent cement, a cement roller and a pair of rolls operatively mounted adjacent said enclosure, said drive arrangement comprising:

(a) a drive shaft;

(b) a pulley secured about one end of said drive shaft and said cement roller secured about the other end of said drive shaft;

(c) a main drive gear mounted on said drive shaft adjacent said pulley;

(d) a second shaft mounted in parallel spaced relation to said drive shaft;

(e) a pair of transfer gears disposed on said second shaft, one of said pair of transfer gears operatively mounted adjacent said main drive gear;

(f) a pair of drive gears cooperating with each other and coaxially mounted with said pair of rolls, with the other of said pair of transfer gears operatively mounted adjacent one of said pair of drive gears; and (g) an arm pivotable between a first position adjacent said cement roller and a second position spaced from said cement roller about an axis that is parallel spaced from said drive shaft, said arm operatively mounting said pair of rolls;

whereby said pulley rotates said pair of top rolls at a speed which is about four times the rotational speed of said cement roller.

6. The drive arrangement of claim 5 wherein said axis of said pivotable arm, the axis of said drive shaft and the axis of said second shaft are disposed in the same plane when said pivotable arm is in its said position adjacent said cement roller.

* * * * *